US012172055B2

(12) United States Patent
Wakibayashi et al.

(10) Patent No.: US 12,172,055 B2
(45) Date of Patent: Dec. 24, 2024

(54) BALL

(71) Applicant: MOLTEN CORPORATION, Hiroshima (JP)

(72) Inventors: Kazuyuki Wakibayashi, Hiroshima (JP); Kunihiko Yamada, Hiroshima (JP); Hisashi Kubota, Hiroshima (JP)

(73) Assignee: MOLTEN CORPORATION, Hiroshima (JP)

( * ) Notice: Subject to any disclaimer, the term of this patent is extended or adjusted under 35 U.S.C. 154(b) by 232 days.

(21) Appl. No.: 16/309,657

(22) PCT Filed: Mar. 29, 2018

(86) PCT No.: PCT/JP2018/013411
§ 371 (c)(1),
(2) Date: Dec. 13, 2018

(87) PCT Pub. No.: WO2019/026343
PCT Pub. Date: Feb. 7, 2019

(65) Prior Publication Data

US 2020/0206582 A1 Jul. 2, 2020

(30) Foreign Application Priority Data

Aug. 1, 2017 (JP) ..... 2017-149539

(51) Int. Cl.
*A63B 41/08* (2006.01)
*A63B 43/00* (2006.01)

(52) U.S. Cl.
CPC ..... *A63B 41/08* (2013.01); *A63B 43/00* (2013.01); *A63B 2209/00* (2013.01)

(58) Field of Classification Search
CPC ..... A63B 41/00; A63B 41/10; A63B 41/085; A63B 41/08; A63B 39/00; A63B 39/06;
(Continued)

(56) References Cited

U.S. PATENT DOCUMENTS 3,256,019 A * 6/1966 Barton ..... A63B 37/0097 473/597
7,749,116 B2 7/2010 Tang et al.
(Continued)

FOREIGN PATENT DOCUMENTS

DE 4408047 A1 * 9/1995 ..... A63B 41/08
EP 3 281 678 2/2018
(Continued)

OTHER PUBLICATIONS

JP-2009006052 Translation Jan. 2009 All Pages.*
(Continued)

*Primary Examiner* — Steven B Wong
(74) *Attorney, Agent, or Firm* — GREENBLUM & BERNSTEIN, P.L.C.

(57) ABSTRACT

A ball body is covered by a plurality of skin members formed integrally of a soft material comprised of resin or rubber as a shaped structure having a front wall portion, a circumferential wall portion and a recess portion altogether. In the recess portion, between the ball body and each skin member, there is formed a hollow portion surrounded by the ball body and the respective skin member and separating the ball body and the front wall portion from each other. As a cushion portion and an air present portion are coexistent in each hollow portion, when a person grips a ball, the cushion portion is collapsed to increase the area of contact between the outer face of the ball and the pulp(s) of the finger(s), thus facilitating the person's gripping of the ball. The readily grippable state of the ball can be maintained for a long period of time.

8 Claims, 4 Drawing Sheets

(58) Field of Classification Search
CPC ..... A63B 37/06; A63B 37/02; A63B 37/0098; A63B 37/12; A63B 37/0075; A63B 37/0038; A63B 37/0023; A63B 37/0013; A63B 43/00
USPC ..... 473/604, 607
See application file for complete search history.

(56) References Cited

U.S. PATENT DOCUMENTS

| | | | | |
|---|---|---|---|---|
| 2006/0148601 | A1* | 7/2006 | Ou | A63B 41/10 473/601 |
| 2016/0310802 | A1 | 10/2016 | Wakibayashi et al. | |

FOREIGN PATENT DOCUMENTS

| | | | | |
|---|---|---|---|---|
| JP | 2009-6052 | | 1/2009 | |
| JP | 2009006052 | A * | 1/2009 | A63B 41/08 |
| JP | 2009-153541 | | 7/2009 | |
| JP | 2016-221117 | | 12/2016 | |
| JP | 2016221117 | A * | 12/2016 | |
| WO | 2015/099186 | | 7/2015 | |
| WO | 2016/163555 | | 10/2016 | |

OTHER PUBLICATIONS

DE 4408047 Translation Sep. 1995 All Pages.*
Internation Search Report issued in International Patent Application No. PCT/JP2018/013411, dated May 15, 2018, along with English-language translation.
Written Opinion issued in International Patent Application No. PCT/JP2018/013411, dated May 15, 2018, along with partial English-language translation.

* cited by examiner

BALL

TECHNICAL FIELD

This disclosure relates to a readily grippable ball.

BACKGROUND ART

This applicant previously proposed a readily grippable ball in Patent Document 1. However, the ball disclosed in Patent Document 1 is configured such that a ball body is covered by a plurality of skin members and an amount of air or a cushioning portion entirely fills a hollow portion surrounded by the ball body and the respective skin member. With this configuration, this ball 1 is readily grippable when gripped by a person, but its grippability is uniform.

BACKGROUND ART DOCUMENT

Patent Document

Patent Document 1: Japanese Re-published Patent Application No. 2015/099186

SUMMARY

Object to be Achieved by Invention

The present invention has been made in view of the above-described state of the art and its principal object is to provide a readily grippable (or readily grabbable) ball having an air present portion and a cushion portion coexist in a hollow portion surrounded by a ball body and a respective skin member.

Solution

According to a characterizing feature of the present invention, there is proposed a ball having a ball body covered by a plurality of skin members:

wherein the respective skin member includes:

a front wall portion corresponding to a front face of the ball body;

a circumferential wall portion protruding from a circumferential edge of the front wall portion toward the ball body; and a recess portion surrounded by the front wall portion and the circumferential wall portion and opened to a back face of the front wall portion; and wherein as the plurality of skin members cover the ball body, the recess portion forms a hollow portion surrounded by the ball body and the skin member, with a cushion portion and an air present portion being coexistent in the hollow portion.

Preferably, in the inventive ball:

the cushion portion has an outer shape to be accommodated in the hollow portion in such a manner that a front face of the cushion portion comes into contact with an upper face of the hollow portion on the side of the front wall portion, an outer circumferential face of the cushion portion in a lateral direction comes into contact with an inner circumferential face of the hollow portion in the lateral direction, and a back face of the cushion portion comes into contact with the front face of the ball body;

the cushion portion includes one or a plurality of holes AND/OR one or a plurality of depressions; and when the cushion portion including one or a plurality of holes AND/OR one or a plurality of depressions is accommodated in the hollow portion, the cushion portion is provided in the hollow portion and one or a plurality of holes AND/OR one or a plurality of depressions constitutes the air present portion and the cushion portion and the air present portion coexist in the hollow portion.

Preferably, in the inventive ball:

a front face of the cushion portion comes into contact with an upper face of the hollow portion on the side of the front wall portion, a back face of the cushion portion comes into contact with the front face of the ball body, and the cushion portion has an outer shape in a lateral direction smaller than an outer shape of the hollow portion in the lateral direction; and when the cushion portion is accommodated in the hollow portion, the cushion portion is provided in the hollow portion, a gap is formed between an outer circumferential face of the cushion portion in the lateral direction and an inner circumferential face of the hollow portion in the lateral direction, and the gap constitutes the air present portion, thus allowing the cushion portion and the air present portion to coexist in the hollow portion.

Preferably, in the inventive ball:

a front face of the cushion portion comes into contact with an upper face of the hollow portion on the side of the front wall portion, a back face of the cushion portion comes into contact with the front face of the ball body, and the cushion portion has an outer shape in a lateral direction smaller than an outer shape of the hollow portion in the lateral direction;

the cushion portion includes one or a plurality of holes AND/OR one or a plurality of depressions; and when the cushion portion having the outer shape in the lateral direction smaller than the outer shape of the hollow portion in the lateral direction and including one or a plurality of holes AND/OR one or a plurality of depressions is accommodated in the hollow portion, the cushion portion is provided in the hollow portion, a gap is formed between an outer circumferential face of the cushion portion in the lateral direction and an inner circumferential face of the hollow portion in the lateral direction, and the one or a plurality of holes AND/OR the one or a plurality of depressions constituting the air present portion, thus allowing the cushion portion and the air present portion to coexist in the hollow portion.

Preferably, in the inventive ball:

a plurality of the cushion portions are provided;

the plurality of cushion portions have a shape to be accommodated in the hollow portion in such manner that front faces of the plurality of cushion portion come into contact respectively with an upper face of the hollow portion on the side of the front wall portion, back faces of the cushion portions come into contact respectively with the front face of the ball body, outer circumferential faces of the plurality of cushion portions are spaced respectively apart on the inner side from an inner circumferential face of the hollow portion in the lateral direction, and the plurality of cushion portions are spaced apart from each other also; and when the plurality of cushion portions as being spaced apart from each other are accommodated in the hollow portion cushion portion, the plurality of cushion portions are provided in the hollow portion, gaps are formed between outer circumferential faces of the respective cushion portions in the lateral direction and an inner circumferential face of the hollow portion in the lateral direction, and the gaps constituting the air present portion, thus allowing the cushion portions and the air present portion to coexist in the hollow portion.

Preferably, in the inventive ball:

the cushion portion is bonded to one or both of the ball body and the skin members via an adhesive bonding agent.

Preferably, in the inventive ball:

the respective skin member is formed integrally of a soft material comprised of a resin or a rubber in a shape including the front wall portion, the circumferential wall portion, and the recess portion altogether.

Effect of the Invention

With the present invention, the cushion portion and the air present portion are coexistent in the hollow portion. Thus, when the ball is gripped by a person, the cushion portion will be collapsed to increase the contact area between the ball front face and the ball(s) (pulp(s)) of the person's finger(s), thus facilitating the person's gripping of the ball. Further, if the person's gripping force as the force which collapses the cushion portion becomes a weaker force, as the hand will not be fatigued, there can be achieved another advantage that the readily grippable condition of the ball can be maintained for a long period of time. In the present invention, if the cushion portion is bonded to one or both of the ball body and the skin member via an adhesive bonding agent, even when the outer shape of the cushion portion in the lateral direction is smaller than the outer shape of the hollow portion in the lateral direction, there occurs no positional displacement of the cushion portion relative to the hollow portion, so the readiness of gripping can be maintained.

EMBODIMENTS

In Embodiments 1-4 of the invention shown in FIGS. 1-8, like reference marks/numerals are provided to represent like members and explanation of overlapped portions will be omitted. Further, in FIG. 1, FIG. 3, FIG. 5 and FIG. 7, a ball body 2 and a skin member 3 are illustrated as flat shapes in schematic diagrams, though general practice would illustrate these as arcuate shapes about a center on the inner side of the ball. Also, in FIG. 1, FIG. 3, FIG. 5 and FIG. 7, there are illustrated a state in which on opposed sides of a skin member 3 shown in a solid line, portions of skin members shown in virtual lines are disposed adjacent.

Figure 1:
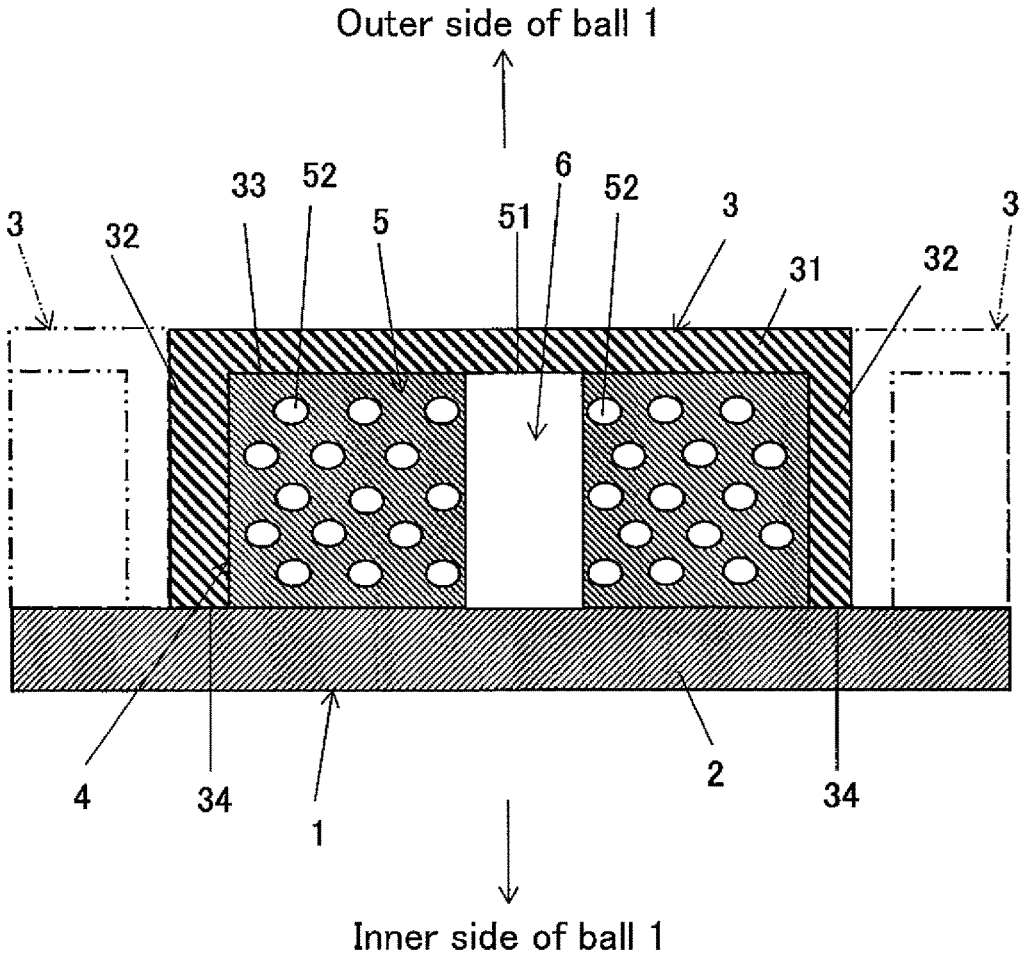
FIG. 1 is a section view showing in section in a diametric direction of a portion of a ball according to Embodiment 1 of the present invention.

Now, with reference to FIG. 1 and FIG. 2, the ball 1 relating to Embodiment 1 of the present invention will be explained. As shown in FIG. 1, in this ball 1, the ball body 2 is covered with a plurality of skin members 3, and a hollow portion 4 surrounded by the ball body 2 and each skin member 3 is formed between the ball body 2 and the respective skin member 3, and within each hollow portion 4, a cushion portion 5 and an air present portion 6 are provided in coexistent. With this configuration, when a person grips this ball 1, each skin member 3 can be receded or deformed concave, thus facilitating the person's gripping of this ball 1. More particularly, when the person grips the ball 1, the cushion portion 5 will be collapsed thereby to increase the area of contact between the front face of the ball 1 and the pulps (balls) of the person's finger(s), thus facilitating the person's gripping of the ball 1. Also, if the person's gripping force as the force to collapse the cushion portion 5 is weak, the hand will not be fatigued, so the readily grippable condition of the ball 1 can be maintained for a long period of time. Thanks to the coexistence of the cushion portion 5 and the air present portion 6 in the hollow portion 4 and the provision of the air present portion 6 in the hollow portion 4, pressure increase resulting from deformation of the cushion portion 5 when the person grips the ball can be suppressed, so that the readily grippable condition can be maintained with a weaker force.

On the other hand, in the case of a conceivable arrangement in which the hollow portion 4 is entirely filled with the cushion portion 5 thus not allowing coexistence of the cushion portion 5 and the air present portion 6 in the hollow portion 4, when a person grips the ball to collapse the hollow portion 4 and the cushion portion 5 with his/her fingers (including thumb), the volume of the hollow portion 4 will be reduced, and the more the hollow portion 4 is collapsed, and the smaller the hollow portion 4 becomes; thus, a pressure increase due to deformation of the cushion portion 5 will suppress deformation of a front wall portion 31 and a circumferential wall portion 32, so readiness of gripping will not be felt.

The ball body 2 can be a spherical body or an elliptical body or a body similar thereto. Further alternatively, aside from such spherical shape, it may be a spherical body or an elliptical body or a body similar thereto having a flat face portion such as a truncated icosahedral body, or may also be an arrangement of string wound around the ball body 2, an arrangement of no string wound around the ball body 2, a hollow structure that allows introduction and extraction of air to/from the inside of the ball body 2, a hollow structure that does not allow introduction and extraction of air to/from the inside of the ball body 2, or a non-hollow structure with the inside of the ball body 2 being filled with a cushion material, and so on.

The skin member 3 is provided as an integrally formed structure including the front wall portion 31, the circumferential wall portion 32 and a recess portion 33 altogether produced by molding of introducing an amount of soft material made of a resin or rubber into a mold for injection molding, a press molding, a vacuum molding, a blow molding etc. However, the skin member 3 can also be a shaped structure not including the front wall portion 31, the circumferential wall portion 32 and the recess portion 33 integrally altogether.

The front wall portion 31 constitutes a wall which faces the outer face of the ball body 2. The circumferential wall portion 32 protrudes from each circumferential edge of the front wall portion 31 toward the ball body 2 and extends annularly all around the circumferential edge of the front wall portion 31. Thus, in the back face of the front wall portion 31, the recess portion 33 is formed like an opening in the back face of the front wall portion 31 and surrounded by the front wall portion 31 and the circumferential wall portion 32.

Incidentally, on the front face which constitutes the outer face of the front wall portion 31, a non-slippery coating formed of uneven or non-slippery material such as wrinkles or dimples or knurling or the like may be provided. In the case of an arrangement in which such coating made of non-slippery material is provided, the coating may be provided on the front face of the front wall portion 31 at the time of molding of the skin member 3 or the coating may be bonded to the front face of the front wall portion 31 of the molded skin member 3.

When the plurality of skin members 3 are attached to the ball body 2 to cover this ball body 2, the respective recess portion 33 forms a hollow portion 4 surrounded by the ball body 2 and the respective skin member 3 and spacing the ball body 2 and the skin member 3 apart from each other. Namely, when the plurality of skin members 3 cover the ball body 2, the hollow portion 4 is surrounded by the ball body 2 and the front wall portion 31 and the circumferential wall portion 32 of the respective skin member 3 and separates the ball body 2 and the front wall portion 31 from each other.

When the plurality of skin members 3 are to be attached to the ball body 2, if the circumferential wall portions 32 of adjacent skin members 3 are bonded to each other via welding or an adhesive bonding agent, this will prevent moisture such as water, sweat or the like from soaking from the borders of the plurality of skin members 3 to the ball body 2 side and will improve the bonding strength between the plurality of skin members 3.

Further, when he plurality of skin members 3 are to be attached to the ball body 2, if an end face 34 of the circumferential wall portion 32 on the side of the ball body 2 is bonded to the front face of the ball body 2 via welding or an adhesive bonding agent, this will prevent positional displacement of the plurality of skin members 3 relative to the ball body 2.

Moreover, when the plurality of skin members 3 are to be attached to the ball body 2, the adjacent front wall portions 31 are disposed away from the front face of the ball body 2 and the recess portion 33 forms, between the ball body 2 and the skin members 3, the hollow portion 4 surrounded by the ball body 2 and the front wall portion 31 and the circumferential wall portion 32. The cushion portion 5 is constituted of a cushioning material such as foamed resin, non-woven fabric, rubber, elastomer, etc.

Figure 2:
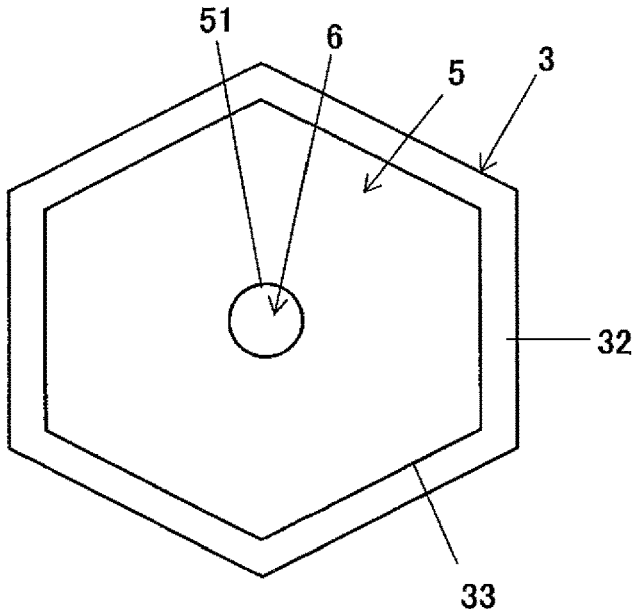
FIG. 2 is a bottom view of a skin member having a cushion portion relating to Embodiment 1 of the present invention.

As shown in FIG. 1 and FIG. 2, the cushion portion 5 has an outer shape to be accommodated in the hollow portion 4 in such a manner that the front face of the cushion portion 5 comes into contact with the upper face of the hollow portion 4 on the side of the front wall portion 31, the outer circumferential face of the cushion portion 5 in a lateral direction comes into contact with an inner circumferential face of the hollow portion 4 in a lateral direction and the back face of the cushion portion 5 comes into contact with the front face of the ball body 2.

Referring back to FIG. 1, in a structure prior to accommodation of the cushion portion 5 in the hollow portion 4, in the cushion portion 5, there are defined one or a plurality of holes 51 extending through between the front wall portion 31 side and the ball body 2 side and a plurality of air containing portions 52 are provided. In place of such one or a plurality of holes 51, one or a plurality of unillustrated depressions may be provided. Further alternatively, one or a plurality of holes 51 and one or a plurality of unillustrated depressions may be provided in coexistent. Such one or a plurality of unillustrated depressions may be opened to the front wall portion 31 side and receded from the front wall portion 31 side to the inside of the cushion portion 5 or may be opened to the ball body 2 side and receded from the ball body 2 side to the inside of the cushion portion 5.

As described above, as the cushion portion 5 having the hole(s) 51 or the unillustrated depression(s) is accommodated in the hollow portion 4, there is provided an arrangement of the cushion portion 5 and the air present portion 6 being provided in coexistent in the hollow portion 4. More particularly, with the accommodation of the cushion portion 5 having the hole(s) 51 and the unillustrated depression(s) in the hollow portion 4, there is realized an arrangement in which the cushion portion 5 is provided in the hollow portion 4, the hole(s) 51 or the unillustrated depression(s) constitute the air present portion 6 and the cushion portion 5 and the air present portion 6 are coexistent in the hollow portion 4. The "air present portion 6" refers to a portion where air is present in the hole(s) 51 or the unillustrated depression(s).

As the cushion portion 5 having the hole(s) 51 or the unillustrated depression(s) is accommodated in the hollow portion 4, the front face of the cushion portion 5 comes into contact with the upper face of the hollow portion 4 on the side of the front wall portion 31, the outer circumferential face of the cushion portion 5 in a lateral direction comes into contact with an inner circumferential face of the hollow portion 4 in a lateral direction and the back face of the cushion portion 5 comes into contact with the front face of the ball body 2. Thus, even if the cushion portion 5 is not bonded with an adhesive bonding agent to one or both of the ball body 2 and the skin member 3, no positional displacement of the cushion portion 5 relative to the hollow portion 4 will occur. Notwithstanding, if the cushion portion 5 is bonded with an adhesive bonding agent to one or both of the ball body 2 and the skin member 3, the bonding strength will be increased advantageously.

Figure 3:
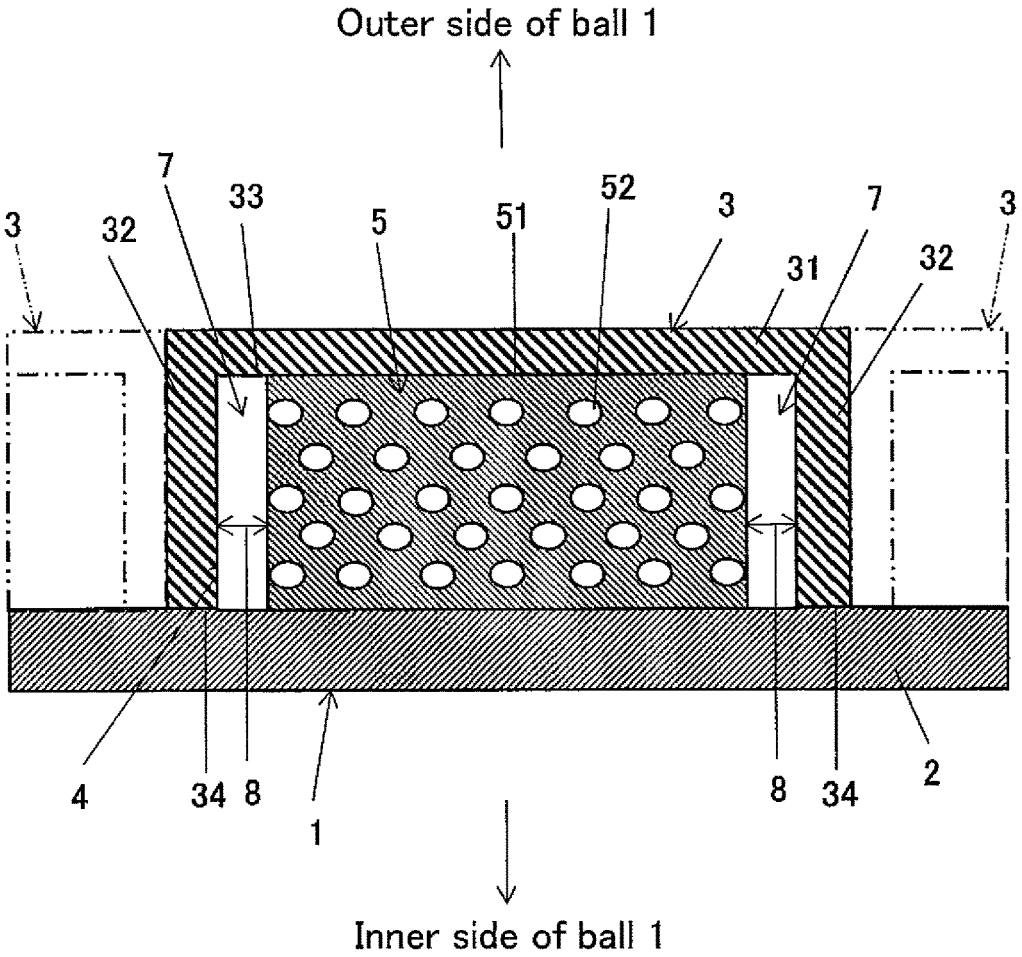
FIG. 3 is a section view showing in section in a diametric direction of a portion of a ball according to Embodiment 2 of the present invention.
Figure 4:
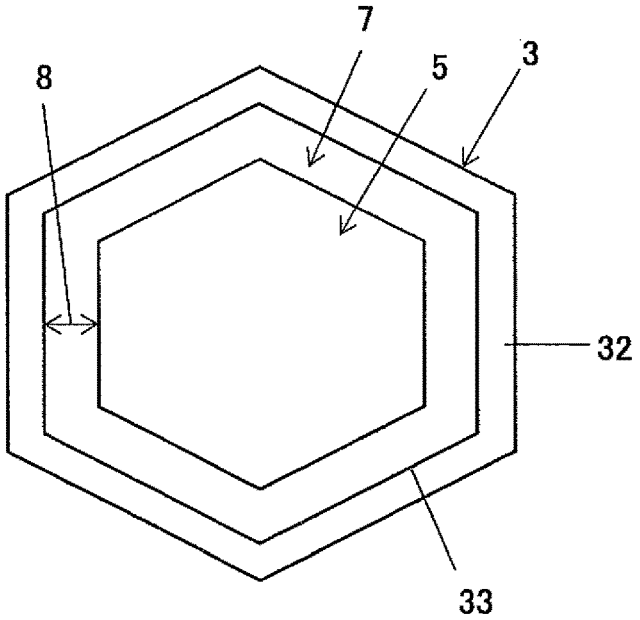
FIG. 4 is a bottom view of a skin member having a cushion portion relating to Embodiment 2 of the present invention.

With reference to FIG. 3 and FIG. 4, a ball 1 relating to Embodiment 2 of the invention will be explained. As shown in FIG. 3, in this ball 1, a ball body 2 is covered with a plurality of skin members 3, and a hollow portion 4 surrounded by the ball body 2 and each skin member 3 is formed between the ball body 2 and the respective skin member 3, and within each hollow portion 4, a cushion portion 5 and an air present portion 6 are provided in coexistent. With this configuration, when a person grips this ball 1, each skin member 3 can be readily receded or deformed concave, thus facilitating the person's gripping of this ball 1. More particularly, when the person grips the ball 1, the cushion portion 5 will be collapsed thereby to increase the area of contact between the front face of the ball 1 and the pulp(s) (ball(s)) of the person's finger(s), thus facilitating the person's gripping of the ball 1. Also, if the person's gripping force as the force to collapse the cushion portion 5 is weak, the hand will not be fatigued, so the readily grippable condition of the ball 1 can be maintained for a long period of time.

As shown in FIG. 3 and FIG. 4, the cushion portion 5 has an outer shape to be accommodated in the hollow portion 4 in such a manner that the front face of the cushion portion 5 comes into contact with the upper face of the hollow portion 4 on the side of the front wall portion 31, the back face of the cushion portion 5 comes into contact with the front face of the ball body 2 and the outer circumferential face of the cushion portion 5 in the lateral direction is separated from the inner circumferential face of the hollow portion 4 in the lateral direction to the inner side. More particularly, the outer shape of the cushion portion 5 in the lateral direction is smaller than the outer shape of the hollow portion 4 in the lateral direction, thus forming a gap 8 between the outer circumferential face of the cushion portion 5 in the lateral direction and the inner circumferential face of the hollow portion 4 in the lateral direction. When the cushion portion 5 is accommodated in the hollow portion 4, the cushion portion 5 is bonded with an adhesive bonding agent to one or both of the ball body 2 and the skin member 3, so that no positional displacement of the cushion portion 5 relative to the hollow portion 4 will occur, and the readily grippable state may be maintained.

Referring back to FIG. 3, in the structure prior to accommodation of the cushion portion 5 in the hollow portion 4, there are provided many air containing portions 52 in the cushion portion 5.

As the cushion portion 5 having an outer shape in the lateral direction smaller than the outer shape of the hollow portion 4 in the lateral direction and having the air containing portions 52 is accommodated in the hollow portion 4 as described above, there is realized an arrangement in which a gap 8 is formed between the outer circumferential face of the cushion portion 5 in the lateral direction and the inner circumferential face of the hollow portion 4 in the lateral direction and the cushion portion 5 and an air present portion 7 are provided in coexistent in the hollow portion 4. More particularly, when the cushion portion 5 having the outer shape in the lateral direction smaller than the outer shape of the hollow portion 4 in the lateral direction is accommodated in the hollow portion 4, there is provided the arrangement in which the cushion portion 5 is provided in the hollow portion 4, the gap 8 constitutes the air present portion 7 and the cushion portion 5 and the air present portion 7 are coexistent in the hollow portion 4. The "air present portion 7" refers to a portion where air is present in the gap 8.

When the cushion portion 5 is accommodated in the hollow portion 4, the cushion portion 5 is bonded to one or both of the ball body 2 and the skin member 3, so that no positional displacement of the cushion portion 5 relative to the hollow portion 4 will occur and the readily grippable state can be maintained.

Figure 5:
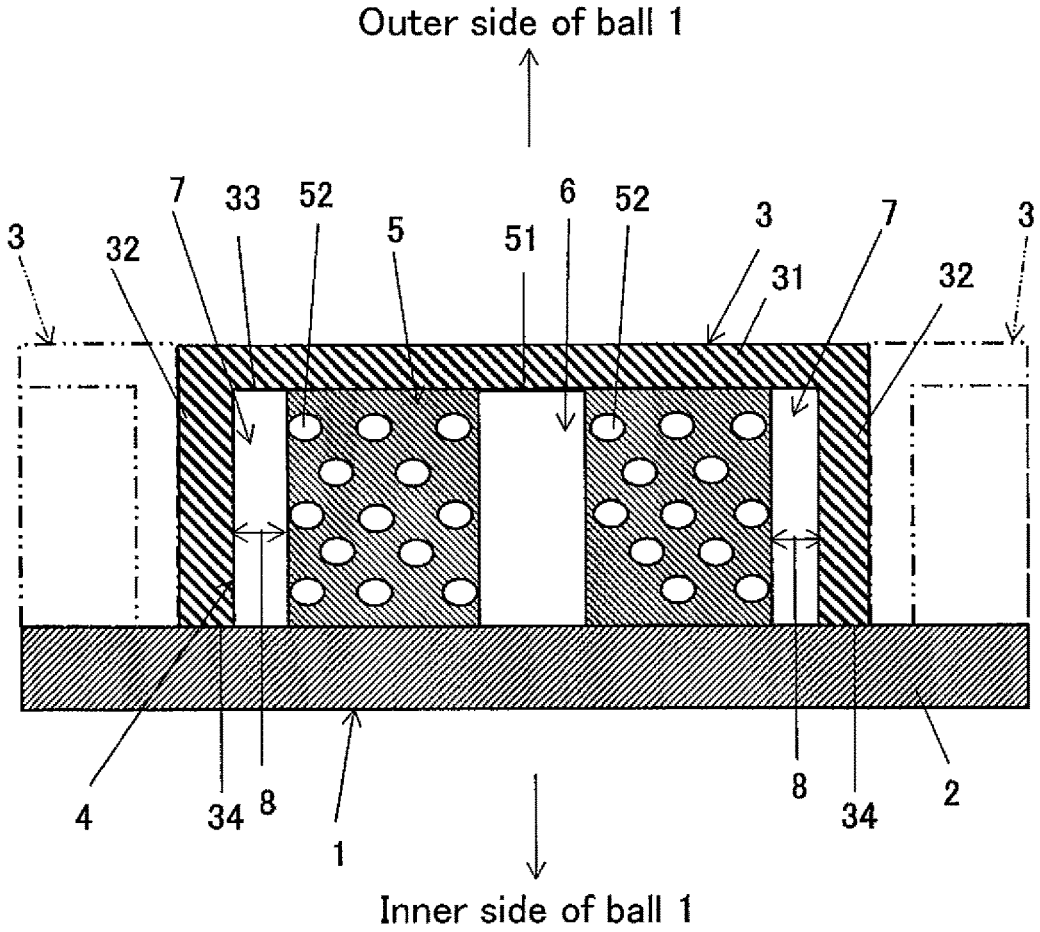
FIG. 5 is a section view showing in section in a diametric direction of a portion of a ball according to Embodiment 3 of the present invention.
Figure 6:
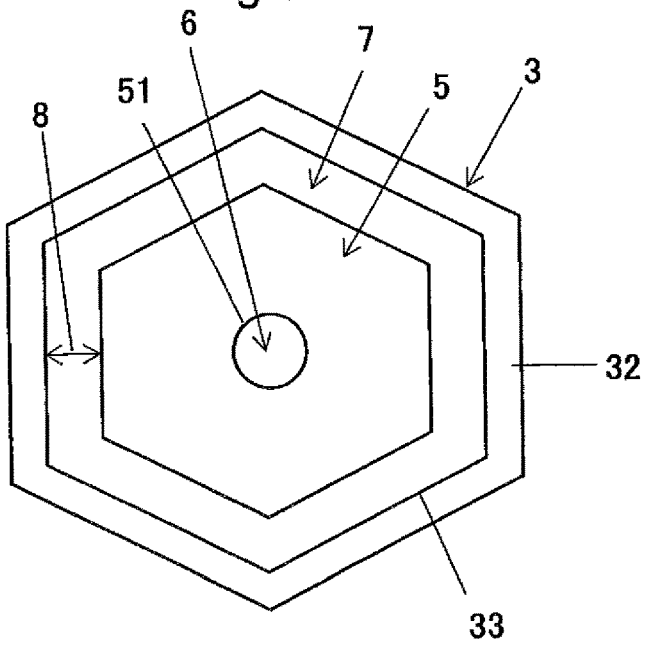
FIG. 6 is a bottom view of a skin member having a cushion portion relating to Embodiment 3 of the present invention.

With reference to FIG. 5 and FIG. 6, a ball 1 relating to Embodiment 3 of the invention will be explained. As shown in FIG. 5, in this ball 1, a ball body 2 is covered with a plurality of skin members 3, and a hollow portion 4 surrounded by the ball body 2 and each skin member 3 is formed between the ball body 2 and the respective skin member 3, and within each hollow portion 4, a cushion portion 5 and air present portions 6 and 7 are provided in coexistent. With this configuration, when a person grips this ball 1, each skin member 3 can be readily receded or deformed concave, thus facilitating the person's gripping of this ball 1. More particularly, when the person grips the ball 1, the cushion portion 5 will be collapsed thereby to increase the area of contact between the front face of the ball 1 and the pulp(s) (ball(s)) of the person's finger(s), thus facilitating the person's gripping of the ball 1. Also, if the person's gripping force as the force to collapse the cushion portion 5 is weak, the hand will not be fatigued, so the readily grippable condition of the ball 1 can be maintained for a long period of time. Moreover, since the air present portions 6 and 7 are provided at the center portion and the circumferential portion of the hollow portion 4, pressure increase resulting from the deformation of the cushion portion 5 when a person grips the ball can be suppressed favorably.

As shown in FIG. 5 and FIG. 6, the cushion portion 5 has an outer shape to be accommodated in the hollow portion 4 in such a manner that the front face of the cushion portion 5 comes into contact with the upper face of the hollow portion 4 on the side of the front wall portion 31, the back face of the cushion portion 5 comes into contact with the front face of the ball body 2 and the outer circumferential face of the cushion portion 5 in the lateral direction is separated from the inner circumferential face of the hollow portion 4 in the lateral direction to the inner side. More particularly, the outer shape of the cushion portion 5 in the lateral direction is smaller than the outer shape of the hollow portion 4 in the lateral direction, thus forming a gap 8 between the outer circumferential face of the cushion portion 5 in the lateral direction and the inner circumferential face of the hollow portion 4 in the lateral direction.

Further, in a structure prior to accommodation of the cushion portion 5 in the hollow portion 4, in the cushion portion 5, there are defined one or a plurality of holes 51 extending through between the front wall portion 31 side and the ball body 2 side and a plurality of air containing portions 52 are provided. In place of such one or a plurality of holes 51, one or a plurality of unillustrated depressions may be provided. Further alternatively, one or a plurality of holes 51 and one or a plurality of unillustrated depressions may be provided in coexistent.

Thus, when the cushion portion 5 having an outer shape in the lateral direction smaller than the outer shape of the hollow portion 4 in the lateral direction and having the hole(s) 51 or the unillustrated depression(s) is accommodated in the hollow portion 4, there is realized an arrangement in which the cushion portion 5 is provided in the hollow portion 4, the hole(s) 51 or the unillustrated depression(s) constitute the air present portions 6, the gap 8 constitutes the air present portion 7 and the cushion portion 5 and the air present portion 6 are coexistent in the hollow portion 4.

When the cushion portion 5 is accommodated in the hollow portion 4, the cushion portion 5 is bonded with an adhesive bonding agent to one or both of the ball body 2 and the skin member 3, so that no positional displacement of the cushion portion 5 relative to the hollow portion 4 will occur, and the readily grippable state may be maintained.

Figure 7:
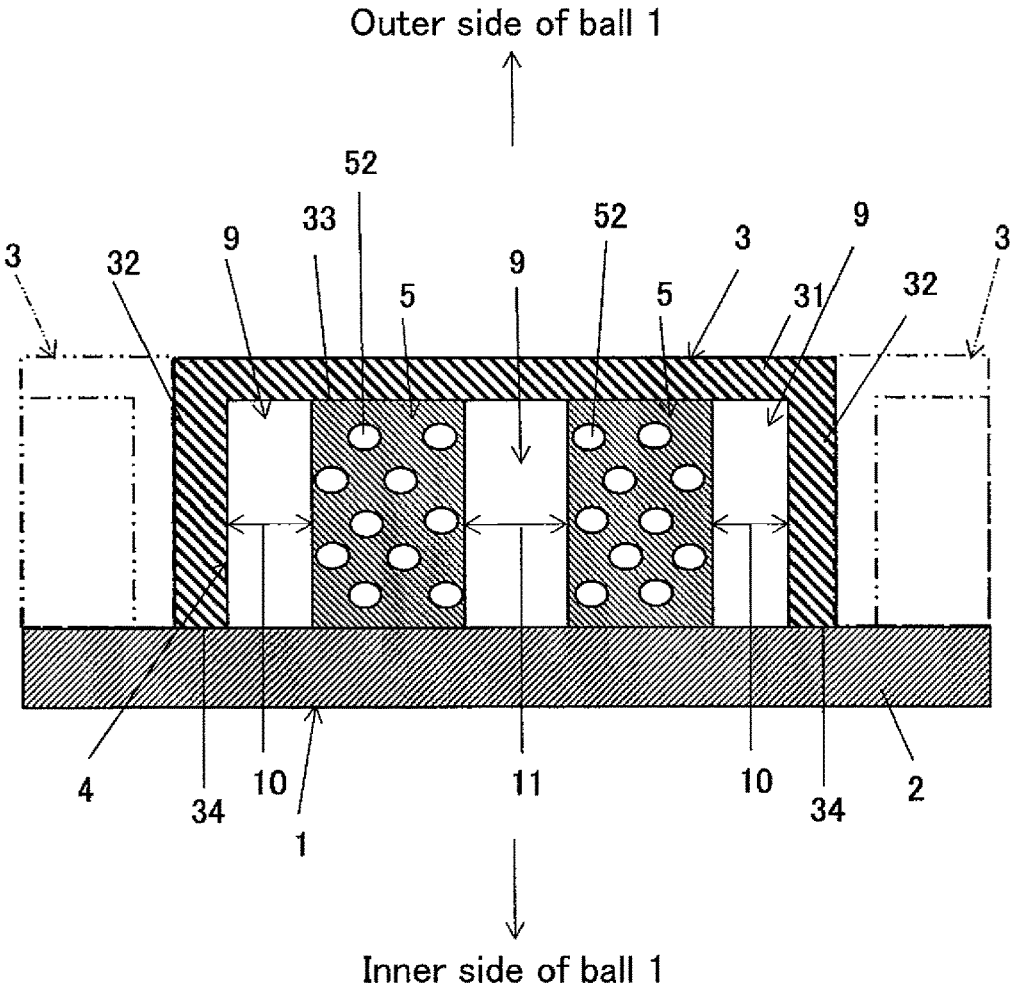
FIG. 7 is a section view showing in section in a diametric direction of a portion of a ball according to Embodiment 4 of the present invention.
Figure 8:
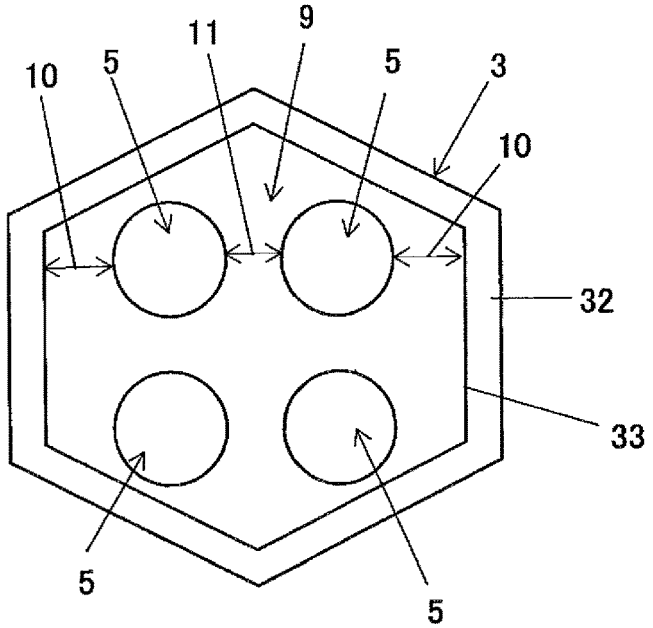
FIG. 8 is a bottom view of a skin member having a cushion portion relating to Embodiment 4 of the present invention.

With reference to FIG. 7 and FIG. 8, a ball 1 relating to Embodiment 4 of the invention will be explained. As shown in FIG. 7, in this ball 1, a ball body 2 is covered with a plurality of skin members 3, and a hollow portion 4 surrounded by the ball body 2 and each skin member 3 is formed between the ball body 2 and the respective skin member 3, and within each hollow portion 4, a plurality of cushion portions 5 and a plurality of air present portions 9 are provided in coexistent. With this configuration, when a person grips this ball 1, each skin member 3 can be readily receded or deformed concave, thus facilitating the person's gripping of this ball 1. More particularly, when the person grips the ball 1, the cushion portion 5 will be collapsed thereby to increase the area of contact between the front face of the ball 1 and the pulp(s) (ball(s)) of the person's finger(s), thus facilitating the person's gripping of the ball 1.

Also, if the person's gripping force as the force to collapse the cushion portion 5 is weak, the hand will not be fatigued, so the readily grippable condition of the ball 1 can be maintained for a long period of time.

As shown in FIG. 7 and FIG. 8, the plurality of cushion portions 5 have an outer shape to be accommodated in the hollow portion 4 in such a manner that the front faces of the plurality of cushion portions 5 come into contact respectively with the upper face of the hollow portion 4 on the side of the front wall portion 31, the back faces of the plurality of cushion portions 5 come into contact respectively with the front face of the ball body 2, the outer circumferential faces of the plurality of cushion portions 5 in the lateral direction are separated respectively from the inner circumferential face of the hollow portion 4 in the lateral direction to the inner side, and also the plurality of cushion portions 5 too are separated from each other. More particularly, the outer shape respectively of the plurality of cushion portions 5 in the lateral direction is a column-like shape smaller than the outer shape of the hollow portion 4 in the lateral direction. Thus, when the plurality of cushion portions 5 as being separated from each other are accommodated in the hollow portion 4, between the outer circumferential face of the respective cushion portion 5 in the lateral direction and the inner circumferential face of the hollow portion 4 in the lateral direction, a gap 10 is formed and also between the outer circumferential faces of the respective cushion portions 5 in the lateral direction, a gap 11 is formed.

As described above, when the plurality of cushion portions 5 respectively having an outer shape in the lateral direction smaller than the outer shape of the hollow portion 4 in the lateral direction and separated from each other are accommodated in the hollow portion 4, there is provided an arrangement in which the plurality of cushion portions 5 are provided in the hollow portion 4, the gaps 10 formed between the outer circumferential faces of the cushion portions 5 and the inner circumferential face of the hollow portion 4 and the gaps 11 formed between the outer circumferential faces of the respective cushion portions 5 in the lateral direction form air present portions 9, and the plurality of cushion portions 5 and the air present portions 9 are coexistent in the hollow portion 4.

When the plurality of cushion portions 5 are accommodated in the hollow portion 4, the plurality of cushion portions 5 are bonded with an adhesive bonding agent to one or both of the ball body 2 and the skin member 3, so no positional displacement of the plurality of cushion portions 5 relative to the hollow portion 4 will occur and readily grippable state can be maintained.

Though not shown in FIGS. 1, 3, 5 and 7, if chamfered portions are formed to chamfer the dihedral angle between the front wall portion 31 and the circumferential wall portion 32 into a sloped face or a curved face, a valley portion based on such chamfered portion will be formed at the border between adjacent skin members 3, so that the finger can be hooked in the valley portion, thus facilitating gripping of the ball 1. Further, it is also possible to give a hand-sewn appearance to the ball 1 by the valley portion. Incidentally, such chamfered portion can be extended to the portion intersecting with the back face of the skin member 3.

In FIGS. 1, 3 and 5, there is shown the arrangement in which the back face of the circumferential wall portion 32 is in contact with or bonded to the front face of the ball body 2. Alternatively, it is possible to arrange such that the thickness of the cushion portion 5 in the front/rear direction is made greater than the depth of the hollow portion 4 in the front/rear direction, the cushion portion 5 is bonded to the back face of the front wall portion 31 and the front face of the ball body 2, a gap is formed between the back face of the circumferential wall portion 32 and the front face of the ball body 2, and the circumferential wall portion 32 is spaced from the ball body 2.

DESCRIPTION OF REFERENCE MARKS/NUMERALS

1: ball
2: ball body
3: skin member
4: hollow portion
5: cushion portion
6: air present portion
7: air present portion
8: gap
9: air present portion
10: gap
11: gap
31: front wall portion
32: circumferential wall portion
33: recess portion
34: end face
51: hole
52: air containing portion

What is claimed is:

1. A ball having a ball body covered by a plurality of skin members:

wherein the respective skin member includes:

a front wall portion corresponding to a front face of the ball body;

a circumferential wall portion protruding from a circumferential edge of the front wall portion toward the ball body; and a recess portion defined by the front wall portion and the circumferential wall portion and opened to a back face of the front wall portion, wherein the plurality of skin members cover the ball body, the recess portion defines a hollow portion surrounded by the ball body, the front wall portion, and the circumferential wall portion, and a cushion portion and an air present portion are coexistent in the hollow portion, the cushion portion extending through the hollow portion so as to contact an upper face of the hollow portion and the front face of the ball body, the air present portion is a gap that is defined between an outer circumferential face of the cushion portion in a lateral direction and an inner circumferential face of the hollow portion in the lateral direction such that the entire inner circumferential face of the hollow portion is separated from the entire outer circumferential face of the cushion portion, and when a gripping force acts on the skin member, the cushion portion is permitted to collapse into the gap between the inner circumferential face of the hollow portion and the outer circumferential face of the cushion portion.

2. The ball of claim 1, wherein:

a front face of the cushion portion comes into contact with the upper face of the hollow portion on the side of the front wall portion, a back face of the cushion portion comes into contact with the front face of the ball body, and the cushion portion has an outer shape in the lateral direction smaller than an outer shape of the hollow portion in the lateral direction; and when the cushion portion is accommodated in the hollow portion, the cushion portion is provided in the hollow portion to allow the cushion portion and the air present portion to coexist in the hollow portion.

3. The ball of claim 1, wherein:

a front face of the cushion portion comes into contact with the upper face of the hollow portion on the side of the front wall portion, and a back face of the cushion portion comes into contact with the front face of the ball body;

the cushion portion includes one or a plurality of holes AND/OR one or a plurality of depressions and the one or the plurality of holes AND/OR the one or the plurality of depressions constitute a portion of the air present portion; and the cushion portion has an outer shape in a lateral direction smaller than an outer shape of the hollow portion in the lateral direction such that the cushion portion and the air present portion are accommodated in the hollow portion.

4. The ball of claim 1, wherein the cushion portion is bonded to one or both of the ball body and the skin members via an adhesive bonding agent.

5. The ball of claim 1, wherein the respective skin member is a soft material comprised of a resin or a rubber in a shape including the front wall portion, the circumferential wall portion, and the recess portion altogether.

6. The ball of claim 1, wherein the air present portion extends entirely through the hollow portion from the back face of the front wall portion to the front face of the ball body.

7. The ball of claim 1, wherein the gap is a plurality of gaps, and one of the plurality of gaps is provided at a center portion of the hollow portion.

8. A ball having a ball body covered by a plurality of skin members:

wherein the respective skin member includes:

a front wall portion corresponding to a front face of the ball body;

a circumferential wall portion protruding from a circumferential edge of the front wall portion toward the ball body; and a recess portion defined by the front wall portion and the circumferential wall portion and opened to a back face of the front wall portion; and wherein:

the plurality of skin members cover the ball body, the recess portion defines a hollow portion surrounded by the ball body, the front wall portion, and the circumferential wall portion, and a cushion portion and an air present portion are coexistent in the hollow portion;

the cushion portion is a plurality of the cushion portions;

the plurality of cushion portions are accommodated in the hollow portion in such manner that front faces of the plurality of cushion portions come into contact respectively with an upper face of the hollow portion on the side of the front wall portion, back faces of the cushion portions come into contact respectively with the front face of the ball body, outer circumferential faces of the plurality of cushion portions are spaced respectively apart on an inner side from an inner circumferential face of the hollow portion in the lateral direction, and the plurality of cushion portions are spaced apart from each other also; and a plurality of gaps are defined between outer circumferential faces of the respective cushion portions in the lateral direction and an inner circumferential face of the hollow portion in the lateral direction such that the entire inner circumferential face of the hollow portion is separated from the entire outer circumferential face of each of the cushion portions to allow the cushion portions and the air present portion to coexist in the hollow portion.

* * * * *